US008152212B2

(12) United States Patent
Sugiyama

(10) Patent No.: US 8,152,212 B2
(45) Date of Patent: Apr. 10, 2012

(54) PINCHING TOOL

(75) Inventor: Mikitoshi Sugiyama, Yodogawa-ku (JP)

(73) Assignee: Green Bell Co., Ltd., Osaka (JP)

( * ) Notice: Subject to any disclaimer, the term of this patent is extended or adjusted under 35 U.S.C. 154(b) by 262 days.

(21) Appl. No.: 12/459,703

(22) Filed: Jul. 7, 2009

(65) Prior Publication Data

US 2010/0001541 A1 Jan. 7, 2010

(30) Foreign Application Priority Data

Jul. 7, 2008 (JP) ..... 2008-176898

(51) Int. Cl.
*B25B 9/02* (2006.01)

(52) U.S. Cl. ..... 294/99.2

(58) Field of Classification Search ..... 294/3, 8.5, 294/11, 16, 99.2; 606/210
See application file for complete search history.

(56) References Cited

U.S. PATENT DOCUMENTS

| | | | | | |
|---|---|---|---|---|---|
| 90,319 | A | * | 5/1869 | Somers | 294/99.2 |
| 389,925 | A | * | 9/1888 | Griscom | 294/106 |
| 420,125 | A | * | 1/1890 | Swain | 294/99.2 |
| 2,300,894 | A | * | 11/1942 | Hedquist | 294/8.5 |
| 2,647,006 | A | * | 7/1953 | Coyle | 294/8.5 |
| 3,653,389 | A | * | 4/1972 | Shannon | 606/210 |
| 4,044,771 | A | * | 8/1977 | Wannag | 606/210 |
| 4,852,929 | A | * | 8/1989 | Shafir | 294/99.2 |
| 5,899,513 | A | * | 5/1999 | Grisoni | 294/99.2 |

FOREIGN PATENT DOCUMENTS

| | | | |
|---|---|---|---|
| GB | 2035187 | * | 6/1980 |
| JP | S55-89583 | A | 6/1980 |
| JP | S59-97847 | A | 6/1984 |
| JP | 3015575 | | 6/1995 |
| JP | 10235566 | * | 9/1998 |
| JP | 2003-530223 | A | 10/2003 |
| JP | 2005-224475 | | 8/2005 |

* cited by examiner

*Primary Examiner* — Dean Kramer
(74) *Attorney, Agent, or Firm* — DLA Piper LLP (US)

(57) ABSTRACT

A pinching tool includes a pair of less deformable elongated plate shape bodies and a resilient body. Each of plate shape bodies has a pinching portion at one end with a flat pinching surface on its inner surface, a supporting portion at another end with a flat contact surface on its inner surface, and a handling portion between the both ends with an inner surface. When the pinching surface and the contact surface of one of the plate shape bodies is brought into contact with those of another of the plate shape bodies, the pinching surfaces and the contact surfaces are respectively tightly in contact with each other. The resilient body is fitted to the supporting portions and couples the pair of the plate shape bodies together to be spring-loaded in a direction of separation of the two plate shape bodies.

8 Claims, 12 Drawing Sheets

PINCHING TOOL

BACKGROUND OF THE INVENTION

1. Field of the Invention

This invention relates to a pinching tool such as tweezers used for plucking a hair, a splinter or the like, and pincers used for pinching various small objects.

2. Description of the Background Art

As Japanese Utility Model Registration No. 3015575 discloses, for example, this kind of pinching tool conventionally includes a pinching body 11 and a holding body 12 as shown in FIGS. 8 and 9. The pinching body 11 is made of a resilient metal plate, and includes resilient pinching legs 13 and 13 in a two-forked form. The pinching legs respectively have tip ends as pinching portions 13*a* and 13*a*, back ends as fixing portions 13*b* and 13*b*, front halves of intermediate portions as handling portions 13*c* and 13*c*, and back halves of the intermediate portions as insertion portions 13*d* and 13*d*. The holding body 12 is made of synthetic resin and provided with an insertion hole 14 with an opening 14*a* having a size appropriate for an optimally opened distance between the resilient pinching legs 13 and 13 and a fixing groove 14*b* for the fixing portions 13*b* and 13*b* of the resilient pinching legs 13 and 13.

The resilient pinching legs 13 and 13 of the pinching body 11 are backwardly inserted into the insertion hole 14 of the holding body 12, the outer surfaces of the insertion portions 13*d* and 13*d* of the resilient pinching legs 13 and 13 are brought into contact with the edge of the opening 14*a* of the insertion hole 14, and the fixing portions 13*b* and 13*b* of the resilient pinching legs 13 and 13 are fixed to the fixing groove 14*b* of the insertion hole 14 so as to form the pinching tool.

Further, as this kind of pinching tool, another example is a pair of tweezers disclosed in Japanese Patent Laying-Open No. 2005-224475, which is shown in FIG. 10. This pair of tweezers is formed by punching a resilient metal plate such as stainless plate with a press so as to produce an elongated plate shape member, part of the resultant member to be a handle 21 is designed and knurled, and then part of the member to be head portions 22 and 22 are bent. Next, the resultant plate shape member is folded into a U shape and then pinching portions 23 and 23 are formed. When the handle 21 is formed with separate handle elements 21 and 21, ends of them are connected together by welding or the like.

The above pinching tool is provided with pinching surfaces 24 and 24 by electrical discharge machining in which, normally while the pinching portions 23 and 23 are kept opened, an electrode is moved from an upper side to a lower side between the pinching portions 23 and 23.

In a case of plucking a hair, a splinter or the like with the conventional pinching tool shown in FIGS. 8 and 9, a user presses the handling portions 13*c* and 13*c* by his fingers, while bringing the pinching portions 13*a* and 13*a* closer to each other, pinches a hair, a splinter or the like between the pinching surfaces 15 and 15 of the pinching portions 13*a* and 13*a*, and then pulls back the tool as it stands.

Further, also with the conventional pinching tool shown in FIG. 10, in a case of plucking a hair, a splinter or the like, a user presses the handle 21 by his fingers, while bringing the pinching portions 23 and 23 closer to each other, pinches a hair, a splinters or the like between the pinching surfaces 24 and 24 of the pinching portions 23 and 23, and then pulls back the tool as it stands.

However, in use of either of the above conventional pinching tools when plucking a hair, a splinter or the like, if the handing portions 13*c* and 13*c* or the handle elements 21 and 21 (or the handle 21) are pressed too strong by a user's fingers for tightly pinching a hair, a splinter or the like, problems would arise. In such a case, as shown in FIGS. 11A, 11B, 12A and 12B, the pinching portions 13*a* and 13*a* extending from the handling portions 13*c* and 13*c* or the pinching portions 23 and 23 extending from the handle elements 21 and 21 are unwantedly bent, which causes the very tip ends 15*a* and 15*a* of the pinching surfaces 15 and 15 or the very tip ends 24*a* and 24*a* of the pinching surfaces 24 and 24 to separate from each other. As a result, pinched hair or splinter is pinched only by back ends 15*b* and 15*b* of the pinching surfaces 15 and 15 or back ends 24*b* and 24*b* of the pinching surfaces 24 and 24. Thus, a pinched area of the hair or the splinter is reduced and the hair or the splinter are likely to slip and come off from the tool while being plucked, and also the hair or the splinter suffers a large pressure thereon and it is likely to be broken or cut when being plucked.

SUMMARY OF THE INVENTION

It is hence an object of the present invention to solve the above conventional problems. Specifically, it is an object of the present invention to provide a pinching tool with which a user can surely pluck a hair, a splinter or the like, even when he or she presses the handling portions too strong by his or her fingers for tightly pinching it, a pinched area of it is not reduced and thus the hair or the splinter is neither slipped nor broken.

Thus a pinching tool according to the present invention includes a pair of less deformable elongated plate shape bodies, each of which has a pinching portion at one end, a supporting portion at other end, a handling portion between the one end and the other end. The pinching portion has a flat pinching surface on its inner surface, while the supporting portion has a flat contact surface on its inner surface. When the pinching surface and the contact surface of one of the plate shape bodies is brought into contact with those of the other of the plate shape bodies, the pinching surfaces and the contact surfaces respectively come tightly in contact with each other. Further a resilient body is fitted to the supporting portions to couple the pair of the plate shape bodies to be spring-loaded in a direction of separation of the two plate shape bodies.

In the pinching tool of the present invention, each of the plate shape bodies may be arched so that, when the pinching surface and the contact surface of one of the plate shape bodies is brought into contact with those of the other of the plate shape bodies, inner surfaces of the handling portions do not come into contact with each other and a space is present therebetween.

Further, in the pinching tool of the present invention, the pinching surface and the contact surface of each of the plate shape bodies may be formed on the same plane.

In the pinching tool of the present invention, each pinching surface may be protuberantly formed on the inner surfaces of the pinching portion, and each contact surface may be protuberantly formed on the inner surface of the supporting portion.

Furthermore in the pinching tool of the present invention, the resilient body may be formed with a pair of resilient plates, one ends of resilient plates are fixed together and stand as base ends and other ends of the resilient plates stand as open ends. Holding pieces are provided on both sides of the open ends and hold side walls provided on both sides of the supporting portions, and indented portions are provided on the open ends and receive protruded portions on outer surfaces of the supporting portions.

The pinching tool of this invention being constituted as mentioned above, when plucking a hair, a splinter or the like, even if a user presses the handling portions too strong by his or her fingers for tightly pinching the hair, the splinter or the like, the pinched area of the hair or the splinters is not reduced and thus the hair or the splinter is neither slipped nor broken. Thus, the pinching tool of the present invention enables to surely pluck a hair or a splinter.

Further, in case of pinching an object other than a hair or a splinter with the pinching tool of the present invention, the area that the object is pinched does not reduce. Therefore, even when a user presses the handling portions too strong by his fingers, the objects are unlikely to be damaged.

DESCRIPTION OF THE PREFERRED EMBODIMENTS

Figure 1:
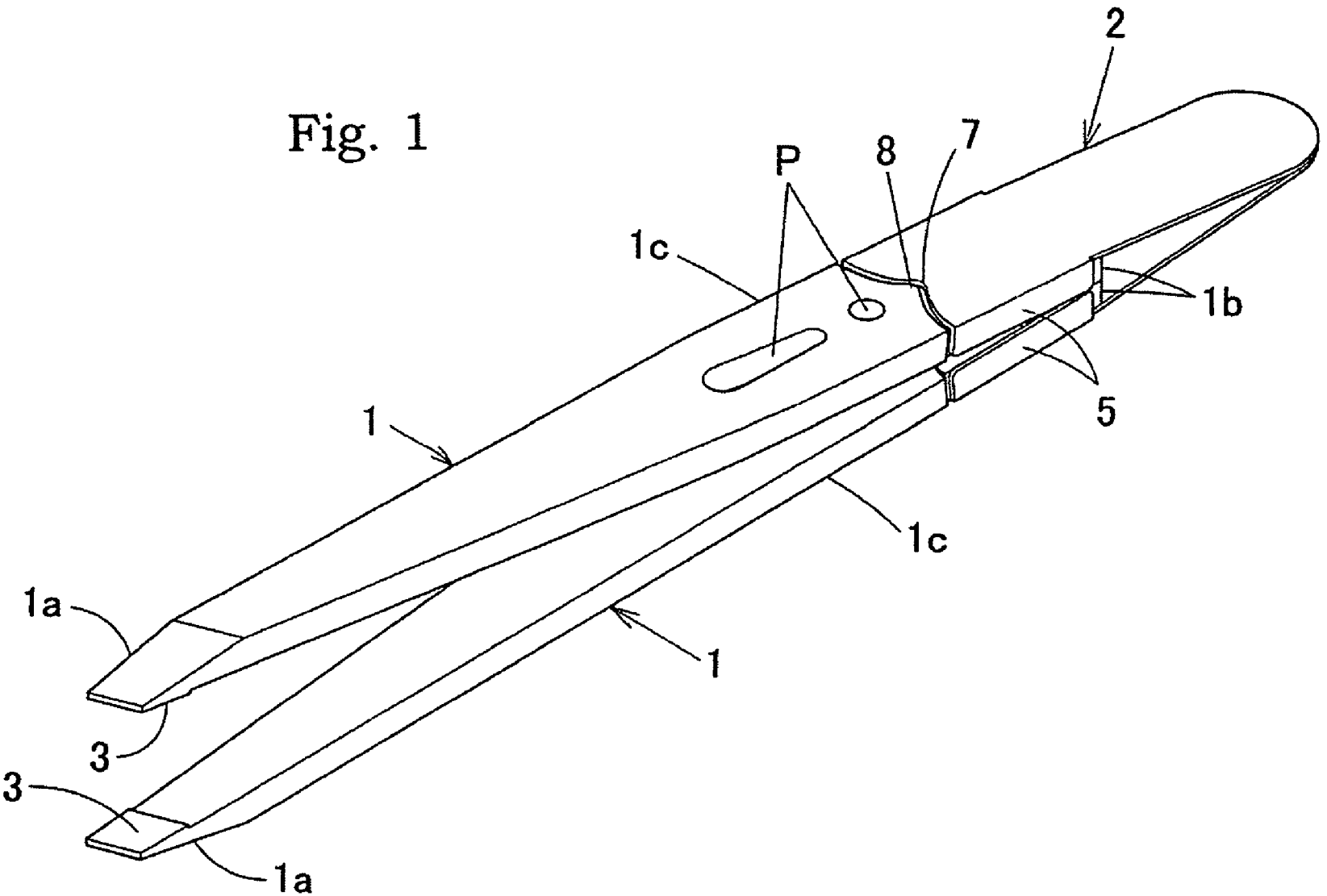
FIG. 1 is a perspective view showing one embodiment of a pinching tool of this invention.
Figure 2:
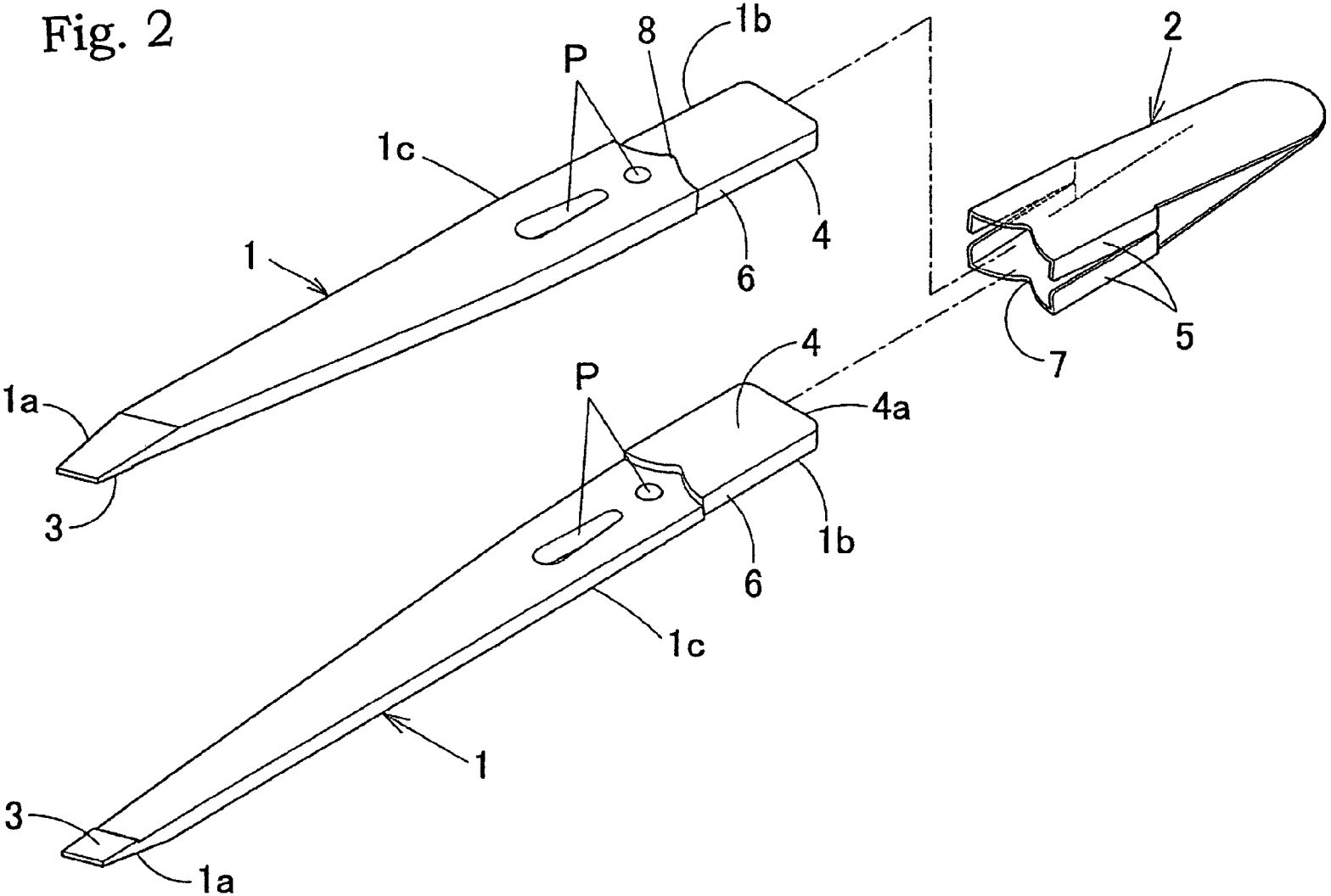
FIG. 2 is an exploded perspective view of the pinching tool of this invention shown in FIG. 1.

Hereinafter, mode for carrying out a pinching tool of this invention will be described in detail in conjunction with drawings.

The pinching tool of this invention is provided with a pair of elongated plate shape bodies 1 and 1 which are less bendable and deformable, and a resilient body 2 for spring-loading the plate shape bodies 1 and 1 in the direction of separating from each other. This resilient body 2 is fitted to an end of each of the plate shape bodies 1 and 1.

Each of the plate shape bodies 1 and 1 is made of a thick metal plate such as stainless plate, and has one end as a pinching portion 1*a*, the other end as a supporting portion 1*b*, and an intermediate portion between the pinching portion 1*a* and the supporting portion 1*b* as a handling portion 1*c*. It should be noted that "less bendable and deformable" as to the pinching tool of this invention means here in the specification that even when a user presses the handling portions 1*c* and 1*c* with his fingers stronger than necessary, the plate shape bodies 1 and 1 are hardly bent and deformed.

An inner surface of each of the pinching portions 1*a* and 1*a* of the plate shape bodies 1 and 1 functions as a pinching surface 3 whose entire surface is flat as shown in the drawing. An inner surface of each of the supporting portions 1*b* and 1*b* functions as a contact surface 4 whose back part is flat as shown in the drawing or whose entire surface is flat. When the handling portions 1*c* and 1*c* are pressed so as to bring the pinching surfaces 3 and 3 and the contact surfaces 4 and 4 respectively into contact with each other to be superposed, the pinching surfaces 3 and 3 and the contact surfaces 4 and 4 respectively come tightly into contact with each other. Although the pinching surface 3 and the contact surface 4 of one plate shape body 1 are preferably formed on the same plane as shown in the drawings because of easy machining when flattening these surfaces, which is not limitative and they may not be on the same plane. For easy positioning of the plate shape bodies 1 and 1 and the like, outer ends 4*a* and 4*a* of the contact surfaces 4 and 4 of the supporting portions 1*b* and 1*b* are preferably brought into contact with each other as shown in the drawing before the handling portions 1*c* and 1*c* are pressed so as to superpose the two pinching surfaces 3 and 3 and the two contact surfaces 4 and 4. However, this is not limitative and the outer ends 4*a* and 4*a* may be separated from each other. Further, a shape of each of the pinching surfaces 3 and 3 is a quadrilateral with angulated corners in the drawing, but this is not limitative and any shape such as a quadrilateral with round corners and an oval may be applicable as long as a hair or a splinter is easily pinched. The size of each of the pinching surfaces 3 and 3 is about 5 to 10 square millimeters, but the size may be any size as long as a hair or a splinter can be pinched. The shape of each of the contact surfaces 4 and 4 is a quadrilateral in the drawing, but any contactable and superposable shape may be employed. The size of each of the contact surfaces 4 and 4 is about 5 to 20 square millimeters, and a size larger than this is not preferable as flattening of a lager surface requires more time and efforts.

The plate shape bodies 1 and 1 are generally slightly arched so that when the pinching surfaces 3 and 3 and the contact surfaces 4 and 4 are brought into contact with each other, the inner surfaces of the handling portions 1*c* and 1*c* do not come into contact with each other and a space S with an arbitrary distance becomes present therebetween. Thereby, a tight contact between the pinching surfaces 3 and 3 and that between the contact surfaces 4 and 4 are improved. It is preferable that the plate shape bodies 1 and 1 have the same curvature because it facilitates machining and the like, but not limitative and they may have different curvatures. Needless to say, the pinching surface 3 and the contact surface 4 on the one plate shape body may be provided either on the same plane or not on the same plane, whether the curvatures of the plate shape bodies 1 and 1 are the same or not.

Further, each of the plate shape bodies 1 and 1 may have a hole or holes P of various shapes which are through from the outer surface to the inner surface on the handling portion 1*c* as shown in the drawing, the outer surfaces of the handling portions 1*c* and 1*c* may be knurled and/or colored. In such a way, the plate shape bodies 1 and 1 may be variously shaped, patterned and/or colored for decoration.

The pinching surfaces 3 and 3 of the plate shape bodies 1 and 1 are provided protuberantly on the inner surfaces of the pinching portions 1 and 1, and the contact surfaces 4 and 4 of the plate shape bodies 1 and 1 are also provided protuberantly on the inner surfaces of the supporting portions 1*b* and 1*b*. With this structure, even when the plate shape bodies 1 and 1 are not generally arched, the inner surfaces of the operation portions 1*c* and 1*c* do not come into contact with each other but a space S with an arbitrary distance is present therebetween. Therefore, a tight contact between the pinching surfaces 3 and 3 and that between the contact surfaces 4 and 4 are enhanced.

The resilient body 2 is formed by folding one thin resilient plate made of such as stainless at a center in which the folded part stands as a base end and the other distal ends stand as open ends with an arbitrary distance between them. Alternatively, the resilient body 2 is formed by superposing two resilient plates as mentioned and connecting one ends of the respective plates together by welding or the like in which the connected ends stand as base ends and the other distal ends stand as open ends with an arbitrary distance between them. The open ends of either of the resilient bodies 2 described above are respectively coupled with associated supporting portions 1*b* and 1*b* of the plate shape bodies 1 and 1 so as to form an assembled pinching tool in which the plate shape bodies 1 and 1 are spring-loaded in the separating direction.

In order to couple the resilient body 2 to the supporting portions 1*b* and 1*b* of the plate shape bodies 1 and 1 respectively, the resilient body 2 is provided with holding pieces 5 and 5 on the both sides of the open ends and indented portions 7 and 7 on the respective tip side of the open ends, while the plate shape bodies 1 and 1 are respectively provided with slightly dented side walls 6 and 6 on the both sides of the supporting portions 1*b* and 1*b* and protruded portions 8 and 8 on the sides of the outer surfaces of the supporting portions 1*b* and 1*b*. In this structure, the holding pieces 5 and 5 hold the side walls 6 and 6, the indented portions 7 and 7 receive the protruded portions 8 and 8, and thus the plate shape bodies 1 and 1 and the resilient body 2 are firmly coupled together. Therefore, the pinching tool of this invention can withstand a long time use and a frequent use and has excellent durability.

Figure 3:
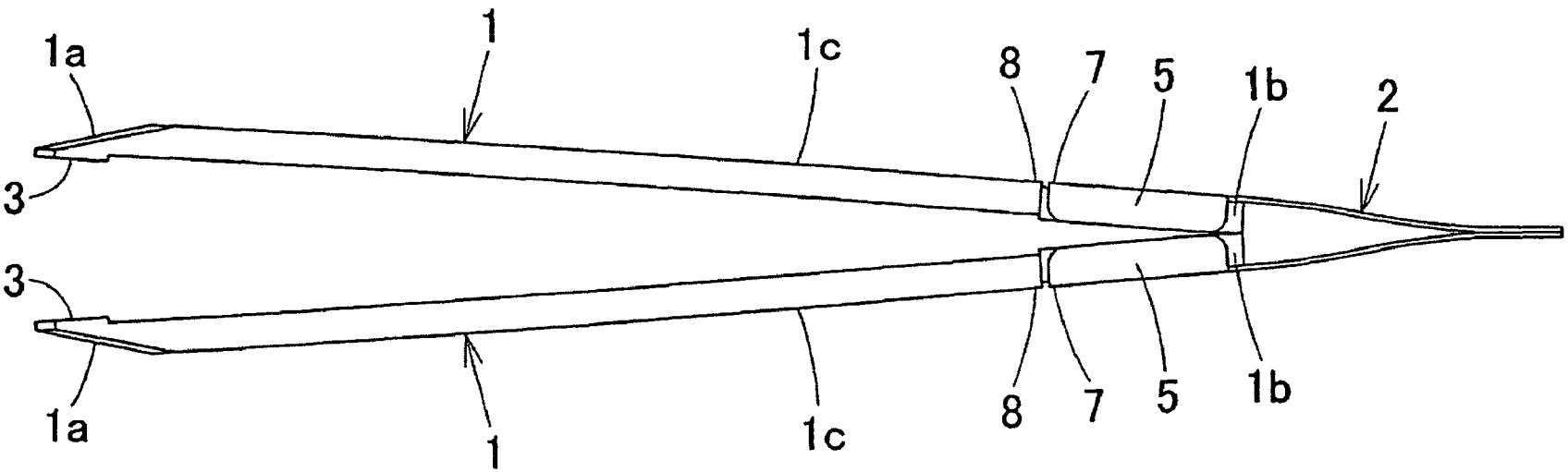
FIG. 3 is a side view of the pinching tool of this invention shown in FIG. 1.
Figure 4:
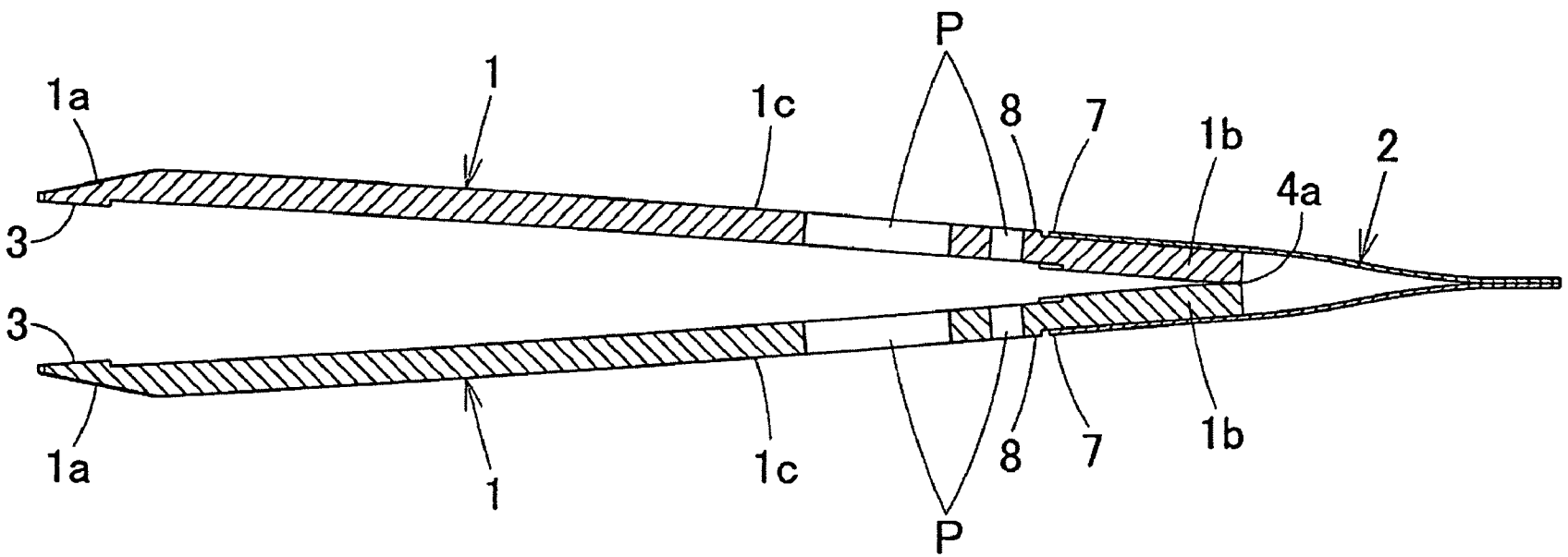
FIG. 4 is a sectional view of the pinching tool of this invention shown in FIG. 1.

In plucking a hair, a splinter or the like with the pinching tool of this invention as constructed above, a user presses the handling portions 1*c* and 1*c* of the pinching tool in the state shown in FIGS. 3 and 4 by his or her fingers to bring the pinching portions 1*a* and 1*a* closer to each other, then pinch and hold a hair, a splinter or the like between the pinching surfaces 3 and 3 of these pinching portions 1*a* and 1*a*, and pull back the pinching tool which is holding the hair, the splinter or the like.

Figure 5:
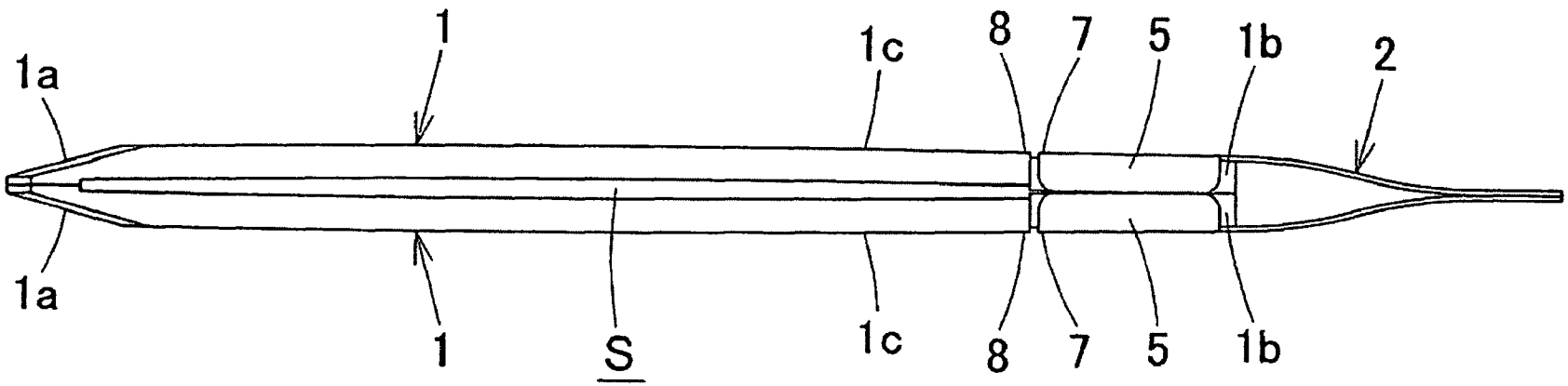
FIG. 5 is a side view of the pinching tool of this invention shown in FIG. 1 in a closed state where pinching surfaces are in contact with each other.
Figure 6:
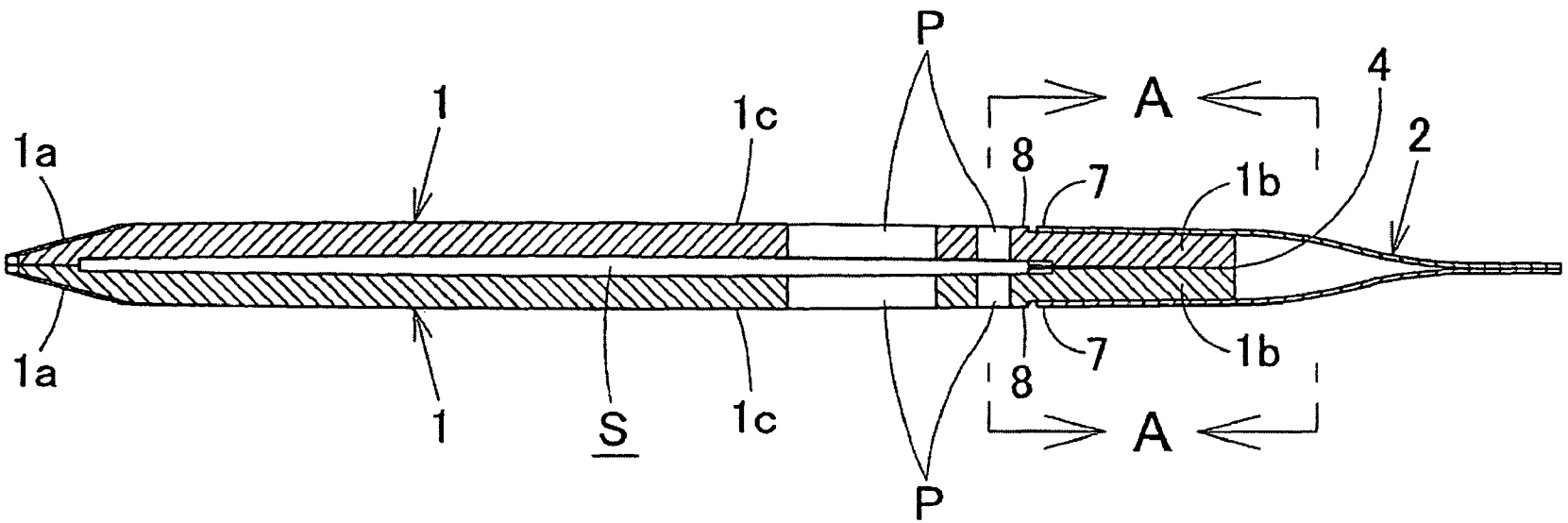
FIG. 6 is a sectional view of the pinching tool of this invention shown in FIG. 1 in the closed state.
Figure 7:
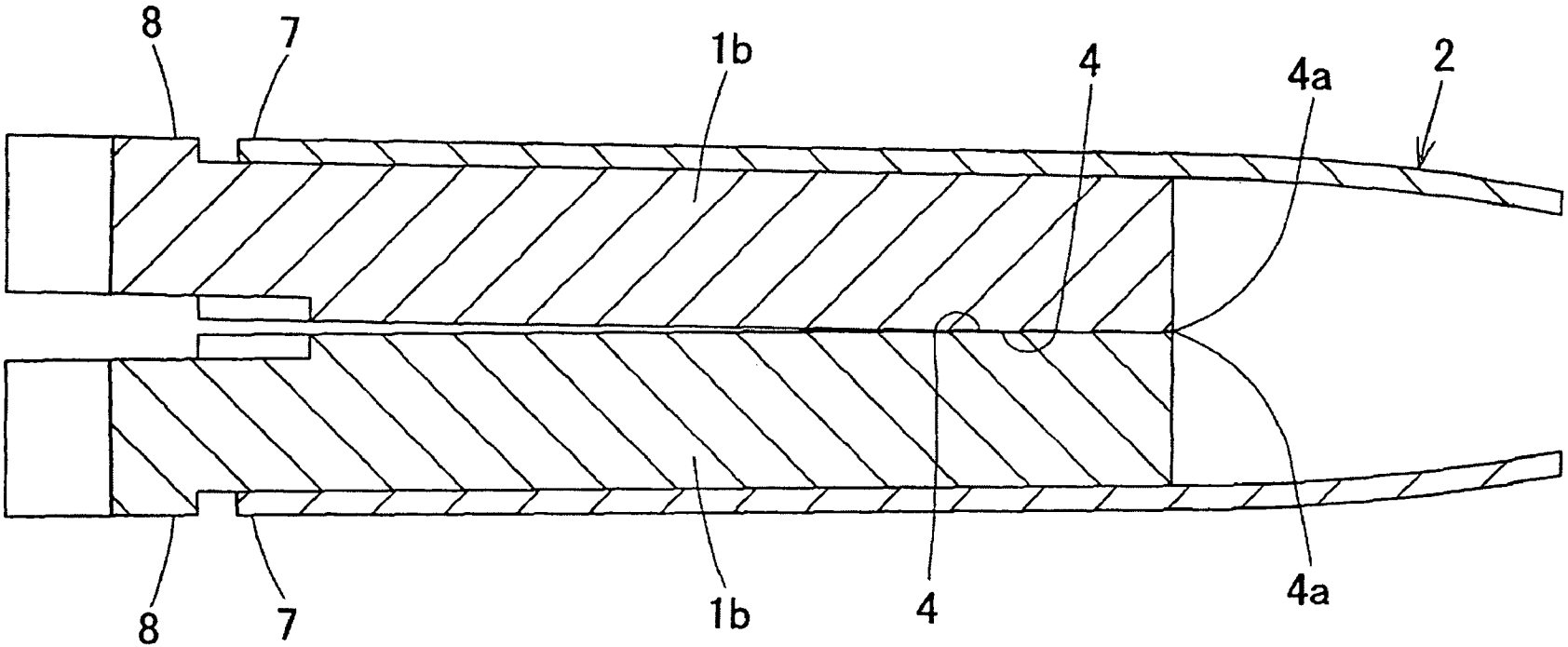
FIG. 7 is an enlarged view of part of the pinching tool of this invention surrounded by A-A shown in FIG. 6.
Figure 8:
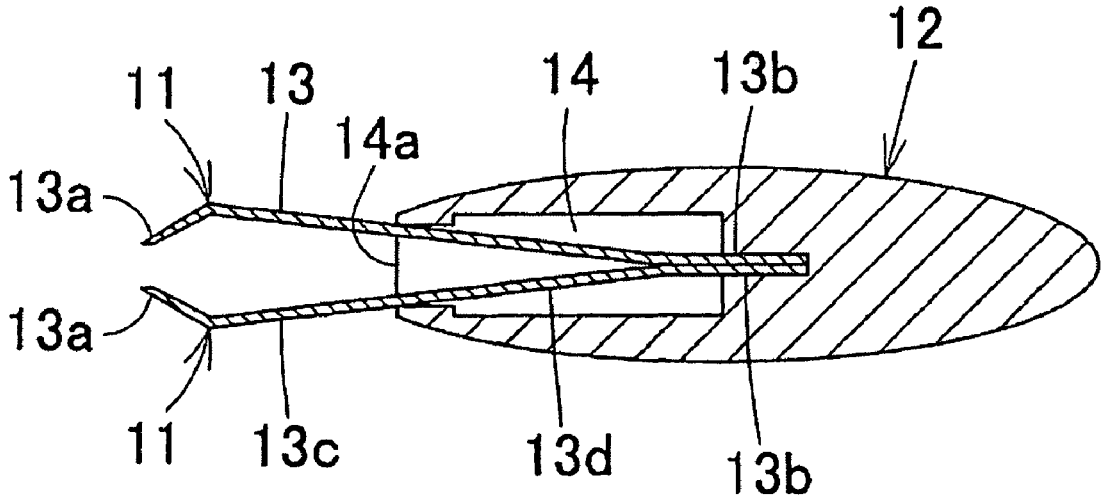
Fig. 8 Prior Art
FIG. 8 is a sectional view showing one example of a conventional pinching tool.
Figure 9:
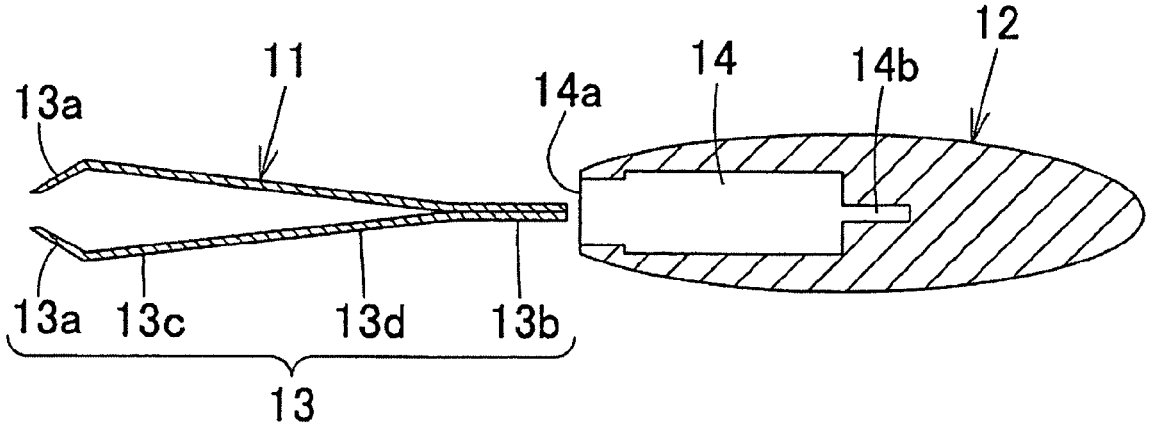
Fig. 9 Prior Art
FIG. 9 is a sectional view of the conventional pinching tool in FIG. 8 in a state that resilient pinching legs are removed from a holding body.
Figure 10:
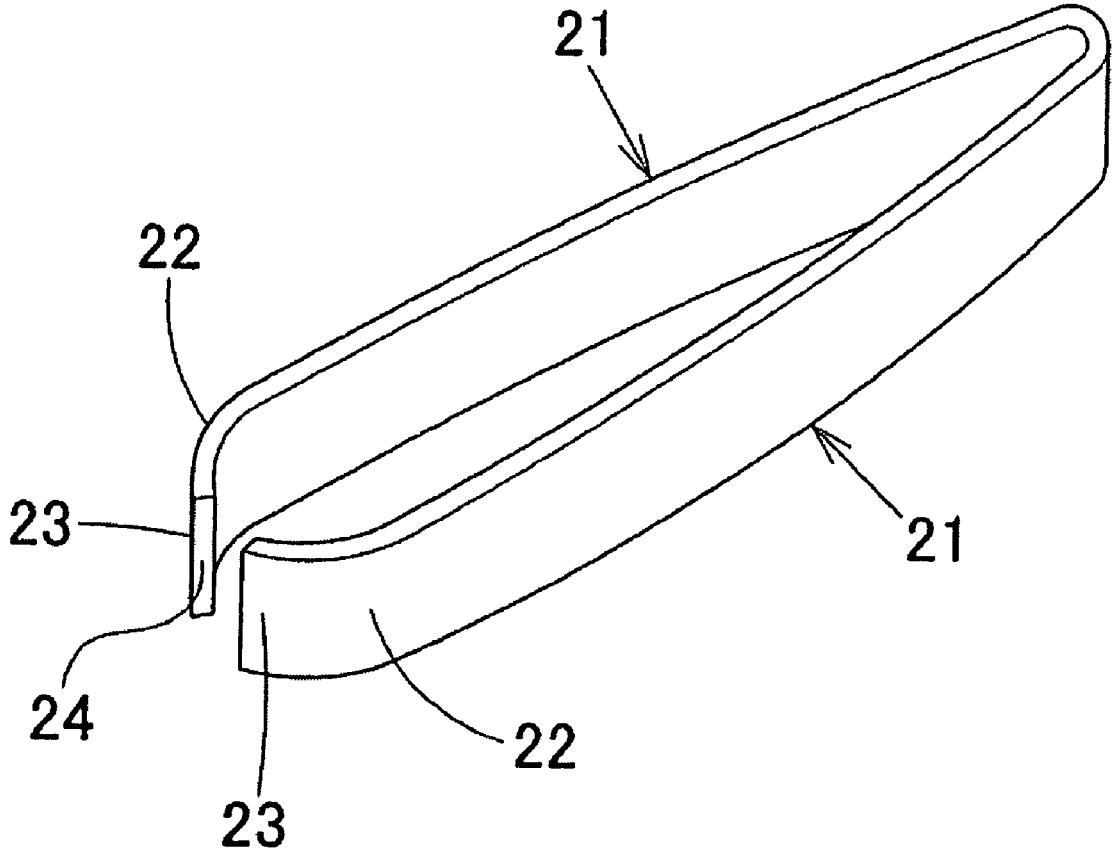
Fig. 10 Prior Art
FIG. 10 is a perspective view showing another example of a conventional pinching tool.
Figure 11A:
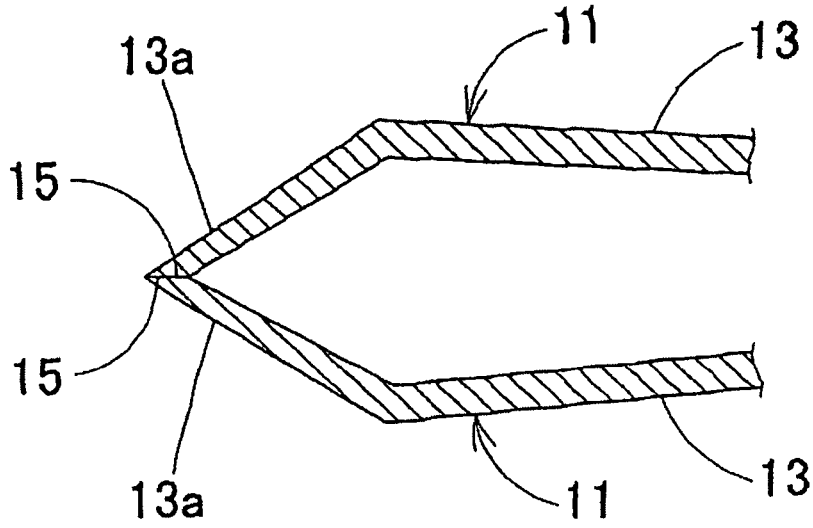
Fig. 11A Prior Art
FIGS. 11A and 11B are illustrative views showing very tip ends of pinching surfaces of the conventional pinching tool shown in FIG. 8 in use.
Figure 11B:
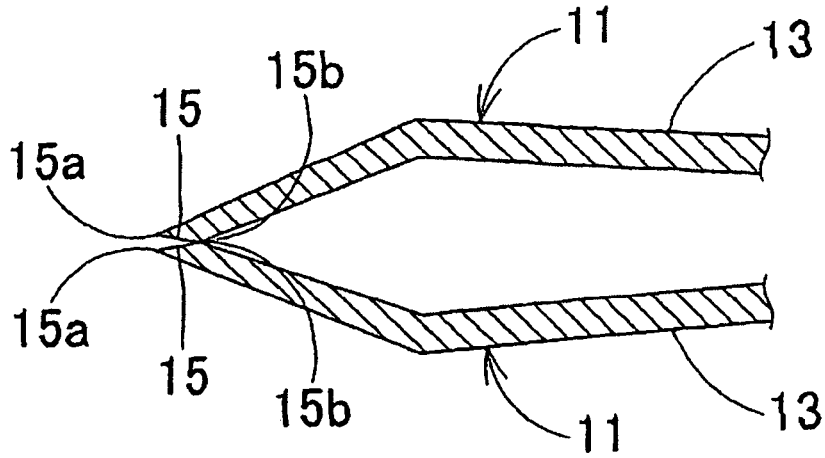
Fig. 11B Prior Art
Figure 12A:
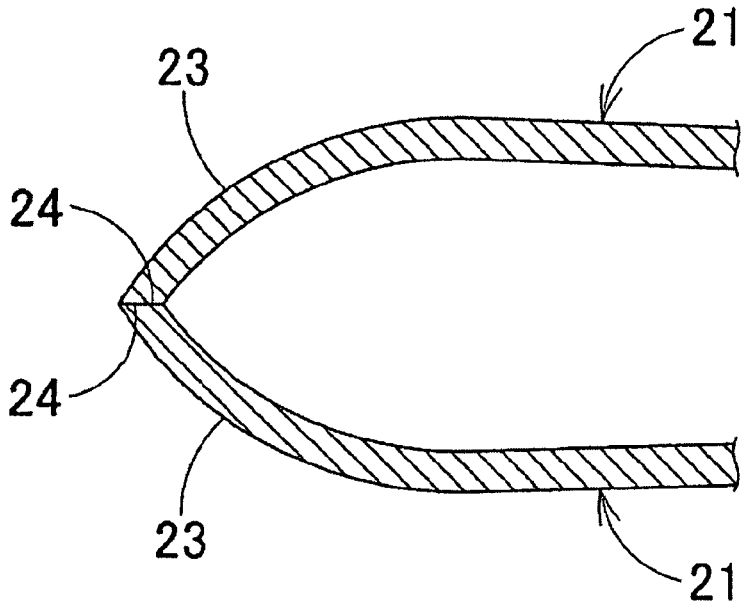
Fig. 12A Prior Art
FIGS. 12A and 12B are illustrative views showing very tip ends of pinching surfaces of the conventional pinching tool shown in FIG. 10 in use.
Figure 12B:
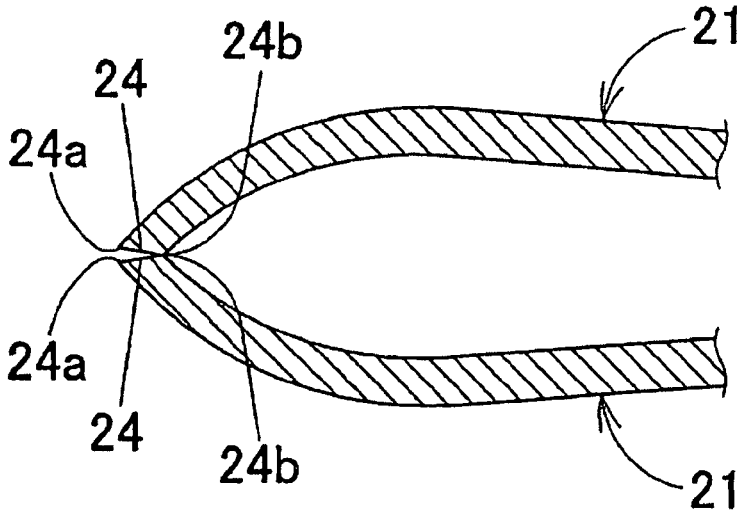
Fig. 12B Prior Art

In this case, even if the user presses any parts of the handling portions 1*c* and 1*c* too strong by his or her fingers for tightly pinching and holding a hair, a splinter or the like, the plate shape bodies 1 and 1, or the pinching tool of the present invention will not unwantedly deformed because of less bendability and less deformability of the plate shape bodies 1 and 1. Consequently, the tip ends of the pinching surfaces 3 and 3 will not separate like in FIG. 11B or 12B, but the pinching surfaces 3 and 3 do tightly contact with each other as show in FIGS. 5 and 6 with a hair or a splinter therebetween. The pinching surfaces 3 and 3 pinch and hold the hair or the splinter with the entire surfaces thereof without reducing the surface areas of pinching a hair or a splinter. Thus, pinched hair or splinter will neither slit out from between the pinching surfaces 3 and 3 nor cut due to the unbearable large pressure when the pinching tool is being pulled back. And with the pinching tool of the present invention, a user can pluck a hair, a splinter or the like without fail.

Further, the pinching tool of this invention may be applicable when pinching an object other than a hair or a splinter as mentioned above. In such case, a pinching area of the object is not reduced, either. Therefore, even when the handling portions 1*c* and 1*c* are pressed too strong with a user's fingers, the object are unlikely to be damaged.

What is claimed is:

1. A pinching tool comprising:

a pair of substantially inflexible elongated plate shape bodies, each of which has a pinching portion at one end with a flat pinching surface on an inner surface, a supporting portion at other end with a flat contact surface on an inner surface, and a handling portion between the one end and the other end with an inner surface;

a resilient body which couples the pair of the plate shape bodies to be spring-loaded in a direction of separation of the two plate shape bodies; and wherein, when the pinching surface and the contact surface of one of the plate shape bodies is brought into contact with those of the other of the plate shape bodies, the pinching surfaces and the contact surfaces are respectively tightly in contact with each other, and the resilient body is fitted to the support portions; and the resilient body is formed with a pair of resilient plates, one end of each of the pair of the resilient plates are fixed together and form a base end and an other end of each of the pair of the resilient plates form an open end, holding pieces are provided on both sides of the open ends and hold side walls provided on both sides of the supporting portions, and indented portions are provided on the open ends and receive protruded portions provided on outer surfaces of the supporting portions.

2. The pinching tool according to claim 1, wherein each of the plate shape bodies is arched, and when the pinching surface and the contact surface of one of the plate shape bodies are brought into contact with those of the other of the plate shape bodies, a space is present between the inner surfaces of the handling portions and the inner surfaces do not come into contact with each other.

3. The pinching tool according to claim 2, wherein the pinching surface is protuberantly formed on the inner surface of the pinching portion and the contact surface is protuberantly formed on the inner surface of the supporting portion.

4. The pinching tool according to claim 2, wherein the pinching surface and the contact surface on each of the plate shape bodies are formed on a same plane.

5. The pinching tool according to claim 4, wherein the pinching surface is protuberantly formed on the inner surface of the pinching portion and the contact surface is protuberantly formed on the inner surface of the supporting portion.

6. The pinching tool according to claim 1, wherein the pinching surface is protuberantly formed on the inner surface of the pinching portion and the contact surface is protuberantly formed on the inner surface of the supporting portion.

7. The pinching tool according to claim 1, wherein the pinching surface and the contact surface on each of the plate shape bodies are formed on a same plane.

8. The pinching tool according to claim 7, wherein the pinching surface is protuberantly formed on the inner surface of the pinching portion and the contact surface is protuberantly formed on the inner surface of the supporting portion.

* * * * *